US009243202B2

(12) United States Patent
Mosier et al.

(10) Patent No.: US 9,243,202 B2
(45) Date of Patent: Jan. 26, 2016

(54) LUBRICATING COMPOSITION CONTAINING A SALT OF A CARBOXYLIC ACID

(75) Inventors: Patrick E. Mosier, Bay Village, OH (US); Scott Capitosti, Perry, OH (US); Ewan E. Delbridge, Concord Township, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 142 days.

(21) Appl. No.: 14/117,377

(22) PCT Filed: Jun. 14, 2012

(86) PCT No.: PCT/US2012/042361

§ 371 (c)(1),
(2), (4) Date: Nov. 13, 2013

(87) PCT Pub. No.: WO2012/174184

PCT Pub. Date: Dec. 20, 2012

(65) Prior Publication Data

US 2015/0141307 A1 May 21, 2015

Related U.S. Application Data

(60) Provisional application No. 61/497,146, filed on Jun. 15, 2011.

(51) Int. Cl.

| | |
|---|---|
| ***C10M 129/44*** | (2006.01) |
| ***C10M 129/54*** | (2006.01) |
| ***C10M 133/06*** | (2006.01) |

(52) U.S. Cl.

CPC ..... *C10M 129/44* (2013.01); *C10M 129/54* (2013.01); *C10M 133/06* (2013.01); *C10M 2201/08* (2013.01); *C10M 2207/128* (2013.01); *C10M 2207/144* (2013.01); *C10M 2215/02* (2013.01); *C10M 2215/04* (2013.01); *C10M 2215/221* (2013.01); *C10M 2215/224* (2013.01); *C10M 2215/226* (2013.01); *C10M 2223/045* (2013.01); *C10N 2230/06* (2013.01); *C10N 2230/10* (2013.01); *C10N 2230/42* (2013.01); *C10N 2230/43* (2013.01); *C10N 2230/45* (2013.01); *C10N 2240/10* (2013.01)

(58) Field of Classification Search

CPC ..... C10M 129/44; C10M 129/54; C10M 133/06; C10M 2201/08; C10M 2207/128; C10M 2207/144; C10M 2215/02; C10M 2215/04; C10M 2215/221; C10M 2215/224; C10M 2215/226; C10M 2223/045; C10N 2230/06; C10N 2230/10; C10N 2230/42; C10N 2230/43; C10N 2230/45; C10N 2240/10

USPC ..... 508/287, 527, 501

See application file for complete search history.

(56) References Cited

U.S. PATENT DOCUMENTS

| | | | | |
|---|---|---|---|---|
| 2,795,548 | A | 6/1957 | Thomas et al. | |
| 3,336,349 | A | 8/1967 | Voris | |
| 3,625,859 | A * | 12/1971 | Hashimoto et al. | 516/68 |
| 3,790,478 | A | 2/1974 | Rudston et al. | |
| 3,840,462 | A * | 10/1974 | Geretschlager | 508/505 |
| 5,102,569 | A | 4/1992 | Onopchenko et al. | |
| 5,576,274 | A | 11/1996 | Patil | |
| 5,667,539 | A | 9/1997 | Jackson et al. | |
| 7,423,000 | B2 | 9/2008 | Williamson et al. | |
| 7,582,126 | B2 | 9/2009 | Martyak et al. | |
| 2006/0019840 | A1 | 1/2006 | Kawahara et al. | |
| 2006/0270567 | A1 * | 11/2006 | Kurihara et al. | 508/192 |

FOREIGN PATENT DOCUMENTS

| | | |
|---|---|---|
| BE | 425425 | 1/1938 |
| FR | 1537892 | 9/1968 |
| FR | 2063994 | 7/1971 |
| GB | 440590 A * | 1/1936 |
| GB | 1162818 | 8/1969 |
| GB | 1180386 | 2/1970 |
| GB | 1180389 | 2/1970 |
| GB | 1358046 | 6/1974 |

OTHER PUBLICATIONS

Search Report from corresponding International Application No. PCT/US2012/042361 dated Nov. 6, 2012.

Written Opinion from corresponding International Application No. PCT/US2012/042361 dated Nov. 6, 2012.

* cited by examiner

*Primary Examiner* — James Goloboy

(74) *Attorney, Agent, or Firm* — Iken S. Sans; Christopher D. Hilker; Teresan W. Gilbert

(57) ABSTRACT

The invention provides a lubricating composition containing an oil of lubricating viscosity and an amine or ammonia salt of a carboxylic acid compound where said carboxylic acid is characterized in that it is functionalized with a hydroxy-substituted aromatic moiety. The invention further relates to methods of lubricating an internal combustion engine by supplying the described lubricating composition to the internal combustion engine. The invention further relates to the use of the salt of the carboxylic acid compound as an antiwear agent or an antioxidant.

10 Claims, No Drawings

LUBRICATING COMPOSITION CONTAINING A SALT OF A CARBOXYLIC ACID

FIELD OF INVENTION

The invention provides a lubricating composition containing a salt of carboxylic acid substituted with a hydroxy-aromatic moiety and an oil of lubricating viscosity. The invention further relates to methods of lubricating an internal combustion engine by supplying the described lubricating compositions to the internal combustion engine. The invention further relates to the use of the salt of the carboxylic acid as an antioxidant and/or antiwear agent.

BACKGROUND OF THE INVENTION

It is well known for lubricating oils to contain a number of surface active additives (including antiwear agents, dispersants, or detergents) used to protect internal combustion engines from corrosion, wear, soot deposits and acid build up. Often, such surface active additives can have harmful effects on engine component wear (in both iron and aluminum based components), bearing corrosion or fuel economy. A common antiwear additive for engine lubricating oils is zinc dialkyldithiophosphate (ZDDP). It is believed that ZDDP antiwear additives protect the engine by forming a protective film on metal surfaces. ZDDP may also have a detrimental impact on fuel economy and efficiency and copper corrosion. Consequently, engine lubricants may also contain a friction modifier to obviate the detrimental impact of ZDDP on fuel economy and corrosion inhibitors to obviate the detrimental impact that ZDDP may have on copper corrosion. Friction modifiers and other additives may also increase lead corrosion.

Further, engine lubricants containing phosphorus and sulfur compounds such as ZDDP have been shown to contribute in part to particulate emissions and emissions of other pollutants. In addition, sulfur and phosphorus tend to poison the catalysts used in catalytic converters, resulting in a reduction in performance of said catalysts.

There has been a commercial trend for reduction in emissions (typically reduction of NOx formation, SOx formation) and a reduction in sulfated ash in engine oil lubricants. Consequently, the amounts of phosphorus-containing antiwear agents such as ZDDP, overbased detergents such as calcium or magnesium sulfonates and phenates have been reduced. As a consequence, ashless additives have been contemplated to provide friction or antiwear performance. It is known that surface active ashless compounds such as ashless friction modifiers may in some instances increase corrosion of metal, namely, copper or lead. Copper and lead corrosion may be from bearings and other metal engine components derived from alloys using copper or lead. Consequently, there may be a need to reduce the amount of corrosion caused by ashless additives.

U.S. Pat. No. 3,790,478 discloses an aero gas turbine lubricant containing hindered ester base-stock, an alkylated diphenylamine, and an alkylated phenyl naphthylamine. The lubricant contains 0.01 wt % to 1 wt % of a $C_{1-20}$ alkyl gallate as lead corrosion inhibitor (in particular propyl gallate is mentioned).

British Patent 1 358 046 discloses a lubricant 0.01 wt % to 1 wt % of a $C_{1-20}$ alkyl gallate as lead corrosion inhibitor (in particular propyl gallate is mentioned).

British Patent GB 1 180389 discloses synthetic lubricating compositions useful for the lubrication of engines of jet aircraft. The lubricants contain 0.1 wt % of propyl gallate as a lead corrosion inhibitor.

British Patent GB 1 180 386 discloses an aero gas turbine lubricant. The lubricant contains 0.01 wt % to 1 wt % of a $C_{1-20}$ alkyl gallate as lead corrosion inhibitor (in particular propyl gallate is mentioned with a treat rate of 0.1 wt %).

British Patent GB 1 162 818 discloses synthetic lubricants for use at very high temperatures that occur in area gas turbines. The lubricant contains 0.01 wt % to 1 wt % of a $C_{1-20}$ alkyl gallate as lead corrosion inhibitor (in particular propyl gallate is mentioned with a treat rate of 0.1 wt %).

French Patent FR 2063994 discloses lubricants stabilized against aging by adding 0.2 wt % to 1 wt % of a synergistic mixture of antioxidants based on (i) an ester-substituted phenol and a pentaerythritol phosphite-propyl gallate. The pentaerythritol phosphite-propyl gallate is treated at 0.2 wt % in the examples.

French Patent FR 1 537 892 discloses synthetic lubricants for use at very high temperatures that occur in area gas turbines. The lubricant contains 0.01 wt % to 1 wt % of a $C_{1-20}$ alkyl gallate as lead corrosion inhibitor (in particular propyl gallate is mentioned with a treat rate of 0.1 wt %).

U.S. Pat. No. 3,336,349 discloses alkanoyl esters of trihydroxy benzenes in lubricants to provide thermal and oxidative stability. The lubricants are useful for jet engines.

U.S. Pat. Nos. 7,423,000 and 7,582,126 disclose compositions that may contain catechol compounds such as tertiary alkyl substituted catechols.

U.S. Pat. No. 5,576,274 discloses fuel and lubricant additives useful as dispersants and multifunctional viscosity modifiers wherein a dihydroxyaromatic compound is alkylated with an olefinic polymer and then aminated in such a manner as to oxidize the hydroxyl moieties of the dihydroxyaromatic compound to carbonyl groups.

U.S. Pat. No. 2,795,548 discloses the use of lubricating oil compositions containing a borated alkyl catechol. The oil compositions are useful in the crankcase of an internal combustion engine in order to reduce oxidation of the oil and corrosion and wear of the metal parts of the engine.

U.S. Pat. No. 5,102,569 discloses a method of preparing a borated alkyl aromatic polyol. The borated alkyl aromatic polyol may be used in lubricating oil formulations to reduce oxidation, wear, and deposits in internal combustion engines.

US Patent Application 2006/019840 discloses lubricating oil for bearings, in particular, a lubricating oil for oil impregnated sintered bearings or fluid dynamic bearings. The lubricating oil may contain gallic acid-based compounds.

SUMMARY OF THE INVENTION

The inventors of this invention have discovered a lubricating composition that is capable of providing at least one of antiwear performance, friction modification (particularly for enhancing fuel economy), extreme pressure performance, antioxidant performance, lead, tin or copper (typically lead) corrosion inhibition, decreased corrosiveness towards acrylate or fluoro-elastomer seals, or seal swell performance.

As used herein reference to the amounts of additives present in the lubricating composition disclosed herein are quoted on an oil free basis i.e., amount of actives, unless otherwise noted.

The invention provides a lubricating composition comprising an oil of lubricating viscosity and an amine or ammonia salt of a carboxylic acid, where the acid contains at least one carbonyl functional group (i.e. —COOH or —COOR). The carbon atom of the carbonyl function group of the acid, or the carbon atom of at least on of the carbonyl functional groups of the acid is connected to an aromatic moiety, either by the carbonyl carbon atom being itself directly bonded to a carbon atom in the ring of the aromatic moiety, or by the carbonyl carbon atom being connected to a hydrocarbyl group (i.e. a divalent hydrocarbyl group, or hydrocarbylene group) where the hydrocarbyl group is bonded to a carbon atom in the ring of the aromatic moiety. The aromatic moiety itself includes two or more hydroxy-groups, alkoxy-groups, or mixtures thereof, where these groups are attached to a carbon atom in a ring structure present in the aromatic moiety.

The invention further provides a method of making the described amine or ammonia salts of carboxylic acids.

The invention further provides a method of lubricating an internal combustion engine comprising the step of: (I) supplying to the internal combustion engine the lubricating composition described herein.

The invention further provides the use of the described amine or ammonia salts of carboxylic acids.

DETAILED DESCRIPTION OF THE INVENTION

Various preferred features and embodiments will be described below by way of non-limiting illustration.

The present invention provides a lubricating composition comprising an oil of lubricating viscosity and an amine or ammonia salt of a carboxylic acid comprising at least one carbonyl functional group wherein the carbonyl carbon of the acid is attached directly or through a divalent hydrocarbyl linkage to an aromatic moiety wherein said aromatic moiety includes two or more hydroxy-groups, alkoxy-groups, or mixtures thereof. The amine may be aromatic or aliphatic and may be mono alkylamine, dialkylamine, trialkylamine or even tetraalkyl ammonium.

The Amine or Ammonia Salt of a Carboxylic Acid

In one embodiment the present invention provides a lubricating composition comprising an oil of lubricating viscosity and an amine or ammonia salt of a carboxylic acid wherein the carboxylic acid comprises a compound of formula (1):

Formula (1)

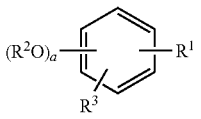

wherein a may be an integer from 2 to 4, or from 2 to 3, or even just 2 or just 3; $R^1$ may be —C(O)OH, or —$R^4$—C(O)OH; each $R^2$ may be independently hydrogen, a linear or branched hydrocarbyl group containing 1 to 10 carbon atoms, or mixtures thereof; $R^3$ may be hydrogen or a hydrocarbyl group containing 1 to 30 carbon atoms; $R^4$ may be a divalent hydrocarbyl group of 1 to 10 carbon atoms which includes —CH═CH—; —$C(R^5)_2C(R^5)_2$— (such as —$CH_2CH_2$—), each $R^5$ may be hydrogen, —CN, $NH_2$, an ester group —C(O)O—$R^6$, or mixtures thereof; and $R^6$ may be hydrogen or a hydrocarbyl group containing 1 to 30, or 6 to 20, or 8 to 15 carbon atoms. In some embodiments the $R^1$ and $R^3$ groups may be linked to form a ring, for example a 5 member or 6 member ring. In some of these embodiments the linked group of $R^1$ and $R^3$ may be —O—C(═O)—$CH_2CH_2$— or —C(═O)—O—$CH_2CH_2$—.

In one embodiment, the aromatic moiety has from 2 to 4 hydroxy-groups, alkoxy-groups, or mixtures thereof, where from 2 to 3 of said hydroxy-groups or alkoxy-groups are located on adjacent carbon atoms of an aromatic ring of said aromatic moiety. By saying the groups are located on adjacent carbon atoms of the aromatic moiety, it is meant that, for example one hydroxy group is bonded to a carbon atom of a ring structure in the aromatic moiety and a second hydroxy group is bonded to the next carbon atom in the same ring structure of the aromatic moiety. These two hydroxy groups are considered to be adjacent to one another. As an additional example, the two $R^{20}$— groups shown in Formula (4a) below are considered to be adjacent to one another.

When two alkoxy-groups (—$OR^2$) of formula (1) have $R^2$ defined as a linear or branched hydrocarbyl, the combined hydrocarbyl groups may be alicyclic or form a cyclic structure. A cyclic structure may be formed by aldehyde (such as formaldehyde, or a reactive equivalent thereof e.g., paraformaldehyde) or ketone bridging of hydroxy-groups located on adjacent carbon atoms. The resultant compound may be represented by formula (1a):

Formula (1a)

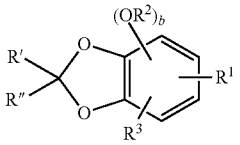

wherein $R^1$, and $R^2$, and $R^3$ are defined above; b=0 or 1; and R' and R" may be independently hydrogen, hydrocarbyl groups containing 1 to 9 carbon atoms (typically R' and R" may be hydrogen), or combinations thereof.

In one embodiment the aromatic carboxylic acid of formula (1) has three hydroxy-groups, alkoxy-groups, or combinations thereof (i.e. a=3), resulting in a compound of formula (2a) or (2b):

Formula (2a)

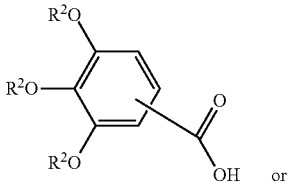

or

Formula (2b)

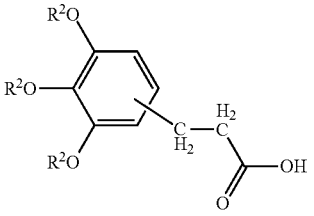

wherein each $R^2$ is independently hydrogen, linear or branched hydrocarbyl groups containing 1 to 10 carbon atoms, or mixtures thereof.

In one embodiment the present invention provides a lubricating composition comprising an oil of lubricating viscosity and an amine or ammonia salt of a carboxylic acid compound of formula (3):

Formula (3)

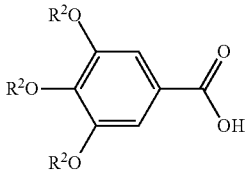

wherein each $R^2$ may be independently hydrogen, hydrocarbyl groups containing 1 to 10 carbon atoms, or mixtures thereof.

In one embodiment the amine or ammonia salt of a carboxylic acid compound comprises a carboxylic acid compound with at least one carbonyl functional group wherein the carbonyl carbon of the acid is attached directly or through a divalent hydrocarbyl linkage to an aromatic moiety wherein said aromatic moiety includes two hydroxy-groups, alkoxy-groups, or mixtures thereof.

In one embodiment the present invention provides a lubricating composition comprising an oil of lubricating viscosity and an amine or ammonia salt of a carboxylic acid compound of formula (4):

Formula (4)

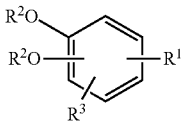

wherein $R^1$, $R^2$ and $R^3$ are defined as above.

In one embodiment the present invention provides a lubricating composition comprising an oil of lubricating viscosity and an amine or ammonia salt of a carboxylic acid compound of formula (4a)

Formula (4a)

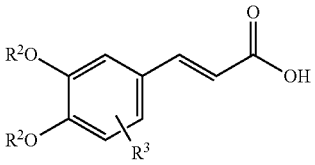

where $R^2$ is defined as above.

In one embodiment the present invention provides a lubricating composition comprising an oil of lubricating viscosity and an amine or ammonia salt of a carboxylic acid comprising at least one carbonyl functional group wherein the carbonyl carbon of the acid is attached directly or through a divalent hydrocarbyl linkage to an aromatic moiety, wherein said aromatic moiety comprises at least two rings and includes two or more hydroxy-groups, alkoxy-groups, or mixtures thereof. A suitable aromatic carboxylic acid may be represented by formula (5a) or (5b):

Formula (5a)

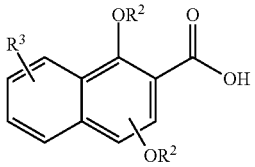

Formula (5b)

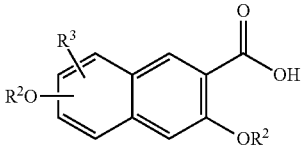

where $R^2$ and $R^3$ are defined as above.

In one embodiment each of the $R^2$ groups in any of the formulas above may be hydrogen. Also, in any of the formulas above, two of the OR groups may be linked to form a cyclic group, for example a 5 member or 6 member ring. For example, two $R^2$ groups in any of the formulas above may be linked to form a ring. In some embodiments, in Formula (4a) the $R^3$ group and one of the $R^2$ groups may be linked to form a ring.

In one embodiment the compound of the invention may be present in a lubricating composition in a range of 0.01 wt % to 10 wt %, 0.1 wt % to 8 wt %, 0.5 wt % to 7 wt %, or 0.25 wt % to 2 wt % of the lubricating composition. In one embodiment the salted acid compound of the invention may be present in a lubricating composition at a minimum amount of 0.01, 0.1, 0.25, 0.5, 1 or even 2 wt % of the lubricating composition. In any of these embodiments the salted acid compound of the invention may be present in a lubricating composition at a maximum amount of 10, 8, 7, 5, 2 or even 1 wt % of the lubricating composition.

In one embodiment the compound of the invention may be borated or non-borated. Borating agents are known in the art and include boric acid, boron trioxide, or borate esters. Borating may occur by reaction of the amine salt of aromatic carboxylic acid of formula (1) with the borating agent at a reaction temperature of 80° C. to 200° C., or 100° C. to 160° C.

In one embodiment the compound of the invention (typically a compound derived from formulae (1), (2a), (2b), (3), (4), (4a), (5a) and/or (5b)) may be present in a lubricating composition in a range of 0.01 wt % to 5 wt %, or 0.1 wt % to 4 wt %, or 0.2 wt % to 3 wt %, or 0.5 wt % to 2 wt % of the lubricating composition.

In one embodiment the lubricating composition of the invention further includes an antiwear agent such as a metal dihydrocarbyl dithiophosphate (typically zinc dialkyldithiophosphate), wherein the metal dihydrocarbyl dithiophosphate contributes at least 100 ppm, or at least 200 ppm, or 200 ppm to 1000 ppm, or 300 ppm to 800 ppm, or 400 ppm to 600 ppm of phosphorus to the lubricating composition.

In one embodiment the invention provides a method of lubricating an internal combustion engine comprising the step of supplying to the internal combustion engine a lubricating composition as disclosed herein. Generally the lubricant is added to the lubricating system of the internal combustion engine, which then delivers the lubricating composition to the critical parts of the engine, during its operation, that require lubrication.

In one embodiment the invention provides for the use of the amine (or ammonia) salts of a carboxylic acid compound, described herein, as at least one of an antioxidant, a dispersant, an antiwear agent, a friction modifier, an extreme pressure agent, a lead, tin or copper (typically lead) corrosion inhibitor, a seal additive that decreases corrosion of acrylate or fluoro-elastomer seals, or a seal additive to improve seal swell performance.

The present invention provides a lubricating composition, a method for lubricating an engine as disclosed above, and the use of the compounds as disclosed above.

The amine (or ammonia) salt of a carboxylic acid compound of formula (1) may be a salt of gallic acid, caffeic acid ((3,4-dihydroxy)trans-cinnamic acid), (3,4,5-trihydroxy) trans-cinnamic acid, 2,5-dihydroxybenzoic acid, 3,4-dihydroxybenzoic acid, or mixtures thereof. The amine (or ammonia) salt of a carboxylic acid compound of formula (5) may be a salt of 1,4-dihydroxy-2-naphthoic acid, 3,5-dihydroxynaphthoic acid, 3,7-dihydroxy naphthoic acid, or mixtures thereof. The carboxylic acid compound of formula (1) may be a trihydroxy compound (i.e., wherein a=3).

In one embodiment formulae (1), (1a), (3), (4), (4a), (5a) and/or (5b) may have $R^3$ defined as hydrogen, alkyl, aryl, alkaryl, alkoxy, aryloxy group, or mixtures thereof. Typically, $R^3$ may be hydrogen.

In different embodiments $R^3$ may be defined as an alkyl group containing 8 to 18, or 5 to 10 carbon atoms.

In one embodiment, the carboxylic acid may be a (poly) hydroxy substituted aromatic compound, an ether and/or alkoxy substituted aromatic compound, or combination thereof. In different embodiments the carboxylic acid compound of the present invention includes at least two substituent groups where the substituent groups are —OH, —OR, or mixtures thereof, wherein R is a hydrocarbyl group. In different embodiments R contains from 1 to 10, 1 to 6 or 1 to 4 carbon atoms. Within any of the carboxylic acid compounds described herein, the substituent groups are typically adjacent to one another or may have one open position between them. For example, the substituent groups may be present in positions 1 and 2, 1 and 3 or 1, 2 and 3 on the aromatic ring of the compound.

In one embodiment the carboxylic acid compound may be an ether-containing aromatic compound, and more specifically, a polyether aromatic compound. In one embodiment the carboxylic acid compound may be 1,2-dimethoxybenzoic acid, 1,3-dimethoxybenzoic acid, 1,2,3 trimethoxybenzoic acid. In one embodiment the compounds of the present invention contains two or three substituents groups where each substituent group is independently a hydroxy-group, a methoxy-group, an ethoxy-group, a propoxy-group, a butoxy-group, a pentoxy-group, a hexoxy-group, or mixtures thereof.

The salt of a carboxylic acid, comprising an aromatic moiety substituted with two or more hydroxy groups or alkoxy groups or mixtures thereof, includes salts of ammonia, a primary amine, a secondary amine, a tertiary amine, a quaternary ammonium ion or mixtures thereof.

Examples of suitable primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleylamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, bis-2-ethylhexylamine, N-methyl-1-amino-cyclohexane, Armeen® 2C and ethylamylamine. The secondary amines may be cyclic amines such as piperidine, piperazine and morpholine.

Examples of tertiary amines include tri-n-butylamine, tri-n-octylamine, tri-decylamine, tri-laurylamine, tri-hexadecylamine, tri-2-ethylhexyl amine, and dimethyloleylamine (Armeen® DMOD)

The amine may be a compound typically having a tertiary amino group. Amines with a tertiary amino group include b1-aminopiperidine, 1-(2-aminoethyl)piperidine, 1-(3-aminopropyl)-2-pipecoline, 1-methyl-(4-methyl-amino)piperidine, 4-(1-pyrrolidinyl)piperidine, 1-(2-aminoethyl)pyrrolidine, 2-(2-aminoethyl)-1-methylpyrrolidine, N,N-diethylethylenediamine, N,N-dimethylethylenediamine, N,N-dibutylethylenediamine, N,N-diethyl-1,3-diaminopropane, N,N-dimethyl-1,3-diaminopropane, N,N,N'-trimethylethylenediamine, N,N-dimethyl-N'-ethylethylenediamine, N,N-diethyl-N'-methylethylenediamine, N,N,N'-triethylethylenediamine, 3-dimethylaminopropylamine, 3-diethylaminopropylamine, 3-dibutylaminopropylamine, N,N,N'-trimethyl-1,3-propanediamine, N,N,2,2-tetramethyl-1,3-propanediamine, 2-amino-5-diethylaminopentane, N,N,N',N'-tetraethyldiethylenetriamine, 3,3'-diamino-N-methyldipropylamine, 3,3'-iminobis(N,N-dimethylpropylamine), or mixtures thereof.

In some embodiments the amine may be N,N-dimethyl-1,3-diaminopropane, N,N-diethyl-1,3-diaminopropane, N,N-dimethylethylene-diamine, N,N-diethylethylenediamine, N,N-dibutylethylenediamine, or mixtures thereof.

In one embodiment the amines may be in the form of a mixture. Examples of suitable mixtures of amines include (i) an amine with 11 to 14 carbon atoms on tertiary alkyl primary groups, (ii) an amine with 14 to 18 carbon atoms on tertiary alkyl primary groups, or (iii) an amine with 18 to 22 carbon atoms on tertiary alkyl primary groups. Other examples of tertiary alkyl primary amines include tert-butylamine, tert-hexylamine, tert-octylamine (such as 1,1-dimethylhexylamine), tert-decylamine (such as 1,1-dimethyloctylamine), tert-dodecylamine, tert-tetradecylamine, tert-hexadecylamine, tert-octadecylamine, tert-tetracosanylamine, and tert-octacosanylamine.

In one embodiment a useful mixture of amines includes "Primene® 81R" or "Primene® JMT." Primene® 81R and Primene® JMT (both produced and sold by Rohm & Haas) may be mixtures of C11 to C14 tertiary alkyl primary amines and C18 to C22 tertiary alkyl primary amines respectively.

In one embodiment the amine salt may be in the form of a quaternary ammonium salt. Examples of quaternary ammonium salts containing a hydroxyalkyl group, and methods for their synthesis, are disclosed in U.S. Pat. No. 3,962,104, see column 1 line 16 through column 2 line 49; column 8 lines 13 through 49, and the Examples. In certain embodiments, the quaternary ammonium compound is derived from a monoamine, i.e., a tertiary amine having only a single amino group, that is, having no additional amine nitrogen atoms in any of the three hydrocarbyl groups or substituted hydrocarbyl groups attached to the tertiary amine nitrogen. In certain embodiments there are no additional amine nitrogen atoms in any of the hydrocarbyl groups or substituted hydrocarbyl groups attached to the central nitrogen in the quaternary ammonium ion. The tetraalkylammonium hydroxide may contain alkyl groups having 1 to 30, or 2 to 20, or 3 to 10 carbon atoms. The tetraalkylammonium hydroxide may include tetrapropylammonium hydroxide, tetrabutylammonium hydroxide, tetrapentylammonium hydroxide, tetrahexylammonium hydroxide, tetra-(2-ethylhexyl)ammonium hydroxide, or tetra(decyl)ammonium hydroxide, or mixtures thereof.

Other examples of quaternary ammonium salt and methods for preparing the same are described in the following patents, which are hereby incorporated by reference, U.S. Pat. No. 4,253,980, U.S. Pat. No. 3,778,371, U.S. Pat. No. 4,171,959, U.S. Pat. No. 4,326,973, U.S. Pat. No. 4,338,206, and U.S. Pat. No. 5,254,138.

When the amine salt is derived from an aromatic amine, the aromatic amine may form an ion such as a pyridinium ion, or an imidazolium ion.

In one embodiment, the amine may be a dispersant containing amine functionality. Such dispersants include succinimide dispersants, described in greater detail herein below.

Salts of primary, secondary or tertiary amines with carboxylic acids will have both basic and acidic character; this character is measured as total base number (TBN) and total acid number (TAN). Neutral salts of quaternary ammonium (i.e. tetraalkylammonium) and carboxylic acids typically have TBN but very little measurable TAN (typically less than 5 mg KOH/g, or less than 1 mg KOH/g, or about 0 mg KOH/g).

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is described in paragraphs [0058] to respectively of WO2008/147704. Synthetic oils may also be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil. In one embodiment the oil of lubricating viscosity may be an API Group I oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives include at least one of metal deactivators, viscosity modifiers, detergents, friction modifiers (other than the compound of the present invention), antiwear agents (other than the compound of the present invention), corrosion inhibitors (other than the compound of the present invention), dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition further includes other additives. In one embodiment the invention provides a lubricating composition further comprising at least one of a dispersant, an antiwear agent (other than the compound of the present invention), a dispersant viscosity modifier, a friction modifier, a viscosity modifier, an antioxidant, an overbased detergent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulfonates and phenates), or mixtures thereof.

The dispersant of the present invention may be a succinimide dispersant, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be a derivative of an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The dispersant may be a N-substituted long chain alkenyl succinimide. Examples of N-substituted long chain alkenyl succinimide include polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

The dispersant may also be post-treated by conventional methods by a reaction with any of a variety of agents. Among these are boron compounds, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present at 0.01 wt % to 20 wt %, or 0.1 wt % to 15 wt %, or 0.1 wt % to 10 wt %, or 1 wt % to 6 wt % or even 5 wt % or 4 wt % of the lubricating composition.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt % of the lubricating composition.

The dispersant viscosity modifier may include functionalized polyolefins, for example, ethylene-propylene copolymers that have been functionalized with an acylating agent such as maleic anhydride and an amine; polymethacrylates functionalized with an amine, or esterified styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph and preparative examples are described paragraphs [0065] to [0073]).

In one embodiment the invention provides a lubricating composition which further includes a phosphorus-containing antiwear agent. Typically the phosphorus-containing antiwear agent may be a zinc dialkyldithiophosphate, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

In one embodiment the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

In one embodiment the invention provides a lubricating composition further comprising an overbased detergent. The overbased detergent may be selected from the group consisting of non-sulfur containing phenates, sulfur containing phenates, sulfonates, salixarates, salicylates, and mixtures thereof.

The overbased detergent may also include "hybrid" detergents formed with mixed surfactant systems including phenate and/or sulfonate components, e.g. phenate/salicylates, sulfonate/phenates, sulfonate/salicylates, sulfonates/phenates/salicylates, as described; for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively.

Typically an overbased detergent may be sodium salts, calcium salts, magnesium salts, or mixtures thereof of the phenates, sulfur containing phenates, sulfonates, salixarates and salicylates. Overbased phenates and salicylates, typically have a total base number of 180 to 450 TBN. Overbased sulfonates typically have a total base number of 250 to 600, or 300 to 500. Overbased detergents are known in the art. In one embodiment the sulfonate detergent may be predominantly a linear alkylbenzene sulfonate detergent having a metal ratio of at least 8 as is described in paragraphs [0026] to [0037] of US Patent Application 2005065045 (and granted as U.S. Pat. No. 7,407,919). The linear alkylbenzene sulfonate detergent may be particularly useful for assisting in improving fuel economy. The linear alkyl group may be attached to the benzene ring any where along the linear chain of the alkyl group, but often in the 2, 3 or 4 position of the linear chain, and in some instances in predominantly in the 2 position, resulting in the linear alkylbenzene sulfonate detergent. Overbased detergents are known in the art. The overbased detergent may be present at 0 wt % to 15 wt %, or 0.1 wt % to 10 wt %, or 0.2 wt % to 8 wt %, or 0.2 wt % to 3 wt %. For example in a heavy duty diesel engine the detergent may be present at or 2 wt % to 3 wt % of the lubricating composition. For a passenger car engine the detergent may be present at 0.2 wt % to 1 wt % of the lubricating composition.

In one embodiment the lubricating composition includes an antioxidant, or mixtures thereof. The antioxidant may be present at 0 wt % to 15 wt 5, or 0.1 wt % to 10 wt %, or 0.5 wt % to 5 wt % of the lubricating composition.

Antioxidants include sulfurized olefins, alkylated diarylamines (typically alkylated diphenylamines such as dinonyl diphenylamine, octyl diphenylamine, dioctyl diphenylamine), hindered phenols, molybdenum compounds (such as molybdenum dithiocarbamates), or mixtures thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of suitable friction modifiers include long chain fatty acid derivatives of amines, fatty esters, or epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides. In some embodiments the term fatty, as used herein, can mean having a $C_{8-22}$ linear alkyl group.

Friction modifiers may also encompass materials such as sulfurised fatty compounds and olefins, molybdenum dialkyldithiophosphates, molybdenum dithiocarbamates, sunflower oil or monoester of a polyol and an aliphatic carboxylic acid.

In one embodiment the friction modifier may be selected from the group consisting of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition.

In one embodiment the friction modifier may be a long chain fatty acid ester. In another embodiment the long chain fatty acid ester may be a mono-ester or a diester or a mixture thereof, and in another embodiment the long chain fatty acid ester may be a triglyceride.

Other performance additives such as corrosion inhibitors include those described in paragraphs 5 to 8 of U.S. application Ser. No. 05/038319, published as WO2006/047486, octyl octanamide, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides may be useful. Foam inhibitors that may be useful in the compositions of the invention include copolymers of ethyl acrylate and 2-ethylhexyl acrylate and optionally vinyl acetate; demulsifiers including trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene, poly(meth)acrylates, polyacrylates or polyacrylamides.

In different embodiments the lubricating composition may have a composition as described in the following table:

| | Embodiments (wt %) | | |
|---|---|---|---|
| Additive | A | B | C |
| Amine salt of Invention (typically derived from formulae (2a), (2b), (3) or (4)) | 0.1 to 4 | 0.2 to 3 | 0.5 to 2 |
| Dispersant | 0.05 to 12 | 0.75 to 8 | 0.5 to 6 |
| Dispersant Viscosity Modifier | 0 or 0.05 to 5 | 0 or 0.05 to 4 | 0.05 to 2 |
| Overbased Detergent | 0 or 0.05 to 15 | 0.1 to 10 | 0.2 to 8 |
| Antioxidant | 0 or 0.05 to 15 | 0.1 to 10 | 0.5 to 5 |
| Antiwear Agent | 0 or 0.05 to 15 | 0.1 to 10 | 0.3 to 5 |
| Friction Modifier | 0 or 0.05 to 6 | 0.05 to 4 | 0.1 to 2 |
| Viscosity Modifier | 0 or 0.05 to 10 | 0.5 to 8 | 1 to 6 |
| Any Other Performance Additive | 0 or 0.05 to 10 | 0 or 0.05 to 8 | 0 or 0.05 to 6 |
| Oil of Lubricating Viscosity | Balance to 100 % | Balance to 100 % | Balance to 100 % |

The amine salted carboxylic acid of invention (typically derived from formula (2a), (3) or (4)) may be present in embodiments (D) 0.1 wt % to 8 wt %, or (E) 1 wt % to 7 wt %, or (F) 2 wt % to 6 wt % of the lubricating composition, with the amount of dispersant viscosity modifier, overbased detergent, antioxidant, antiwear agent, friction modifier, viscosity modifier, any other performance additive (excluding a dispersant) and an oil of lubricating viscosity in amounts shown in the table above for embodiments (A) to (C). The compound of invention derived from formula (1) may also exhibit dispersant performance. If the compound of invention derived from formula (1) exhibits dispersant performance, a portion or all of the dispersant ranges quoted in embodiments (D) to (F) may be 0 wt % to 12 wt %, or 0 wt % to 8 wt % or 0 wt % to 6 wt % of the lubricating composition.

INDUSTRIAL APPLICATION

The lubricating composition may be utilized in an internal combustion engine. The engine components may have a surface of steel or aluminum (typically a surface of steel).

An aluminum surface may be comprised of an aluminum alloy that may be a eutectic or hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine.

The internal combustion engine may be a 2-stroke or 4-stroke engine. Suitable internal combustion engines include marine diesel engines, aviation piston engines, low-load diesel engines, and automobile and truck engines.

The internal combustion engine of the present invention is distinct from gas turbine. In an internal combustion engine individual combustion events which through the rod and crankshaft translate from a linear reciprocating force into a rotational torque. In contrast, in a gas turbine (may also be referred to as a jet engine) it is a continuous combustion process that generates a rotational torque continuously without translation and can also develop thrust at the exhaust outlet. These differences result in the operation conditions of a gas turbine and internal combustion engine different operating environments and stresses.

The lubricant composition for an internal combustion engine may be suitable for any engine lubricant irrespective of the sulfur, phosphorus or sulfated ash (ASTM D-874) content. The sulfur content of the engine oil lubricant may be 1 wt % or less, or 0.8 wt % or less, or 0.5 wt % or less, or 0.3 wt % or less. In one embodiment the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulfated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment the sulfated ash content may be 0.05 wt % to 0.9 wt %, or 0.1 wt % to 0.2 wt % or to 0.45 wt %.

In one embodiment the lubricating composition may be an engine oil, wherein the lubricating composition may be characterized as having at least one of (i) a sulfur content of 0.5 wt % or less, (ii) a phosphorus content of 0.1 wt % or less, (iii) a sulfated ash content of 1.5 wt % or less, or combinations thereof.

EXAMPLES

The following examples provide illustrations of the invention. These examples are non-exhaustive and are not intended to limit the scope of the invention.

Preparative Example 1 (PE1)

Synthesis of Salt of Gallic Acid and bis(2-ethylhexyl)amine

A one liter, four necked, round bottom flask, equipped with an overhead stirrer, sub-surface gas inlet tube, thermowell, Dean-Stark trap, and reflux condenser, is charged with 50 grams (0.294 moles) of gallic acid and 240 grams of Xylenes. The flask is purged with nitrogen and warmed to 140° C. 71 grams of bis(2-ethylhexyl)amine (0.294 moles) is charged to the additional funnel and added dropwise over a period of 20 minutes. The reaction temperature is stirred and held at 145° C. for 7 hours. The reaction mixture is cooled to room temperature and the Xylenes are removed by rotary evaporation (80° C.<10 Torr). The product is isolated in the form of a brown liquid (101 grams). The product has a TBN, by ASTM D2896, of 149.5 mg KOH/g.

Preparative Example 2 (PE2)

Synthesis of Mixed Amine Salt of Gallic Acid

A one liter, four necked, round bottom flask, equipped with an overhead stirrer, sub-surface gas inlet tube, thermowell, Dean-Stark trap, and reflux condenser, is charged with 463 grams (1.0 equiv) of polyisobutenylsuccinimide (polyisobutylene 2300 Mn, TBN=15 mg KOH/g) and heated to 65° C. under nitrogen purge. 71 grams of bis(2-ethylhexyl)amine (2.35 equiv) is charged to the additional funnel and the mixture is heated to 100° C. 50 grams of gallic acid (2.38 equiv) is added dropwise to the reaction mixture over a period of ten minutes. The reaction temperature is stirred and held at 100° C. for 7 hours. The reaction mixture is cooled to room temperature. The product is isolated in the form of a brown oil (566 grams). The product has a TBN, by ASTM D2896, of 39.5 mg KOH/g.

Lubricating Compositions

A series of 5W-30 engine lubricants in a Group II base oil of lubricating viscosity are prepared containing the additive composition of the present invention as well as conventional additives including polymeric viscosity modifier, ashless succinimide dispersant, overbased detergents, antioxidants (combination of phenolic ester and diarylamine), zinc dialkyldithiophosphate (ZDDP), as well as other performance additives as follows. Amounts shown are weight percent.

TABLE 1

Lubricating Oil Composition Formulations

| | Comp EX 1 | Comp EX 2 | Comp EX 3 | EX 1 | EX 2 | EX 3 |
|---|---|---|---|---|---|---|
| Base Oil | | | Balance to = 100% | | | |
| PE1 | 0 | 0 | 0 | 1.0 | 0 | 0.5 |
| PE2 | 0 | 0 | 0 | 0 | 1.0 | 0 |
| Antioxidant[1] | 0 | 1.2 | 1.2 | 0 | 0 | 0.6 |
| ZDDP[2] | 0.76 | 0.76 | 0.45 | 0.45 | 0.45 | 0.45 |
| OCP VM[3] | 7 | 7 | 7 | 7 | 7 | 7 |
| Additional Additives[4] | 5.6 | 5.6 | 5.6 | 5.6 | 5.6 | 5.6 |
| % Phosphorus | 0.076 | 0.076 | 0.050 | 0.050 | 0.050 | 0.050 |
| % Sulfur | 0.25 | 0.25 | 0.20 | 0.20 | 0.20 | 0.20 |
| % Ash | 0.85 | 0.85 | 0.8 | 0.8 | 0.8 | 0.8 |

[1]Mixture of phenolic ester and diarylamine (1:1 wt)

[2]Secondary Zinc dialkyldithiophosphate (mixture of $C_3$—$C_6$ alkyl)

[3]90% Oil

[4]Conventional additives include polyalkylene succinimide dispersant (4 wt %), overbased calcium sulfonate detergent (1.3 wt %), as well as friction modifier and anti-foam agent, each of which may contain a conventional amount of diluent (not separately accounted for).

Wear Performance of Amine-Salted Carboxylic Acids

The lubricating oil compositions summarized in Table 1 are evaluated for boundary lubrication friction performance and wear in a programmed temperature high frequency reciprocating rig (HFRR) available from PCS Instruments. HFRR conditions for the evaluations were 500 g load, 75 minute duration, 1000 micrometer stroke, 20 Hertz frequency, and at a temperature of 105° C. The wear and contact potential are then measured.

The lubricating compositions are also subjected to the ACEA E5 oxidation bench test (CECL85) which determined oxidative stability of a sample by pressure differential scanning calorimetry. Results are reported as the time (in minutes) until the oil breaks and takes up oxidation.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference, as is the priority document and all related applications, if any, which this application claims the benefit of. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A lubricating composition comprising an oil of lubricating viscosity and an amine or ammonia salt of a carboxylic acid wherein the carboxylic acid has the formula (4a):

Formula (4a)

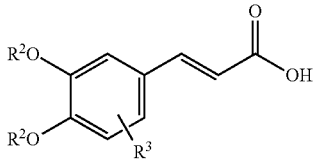

wherein each $R^2$ is independently hydrogen, linear or branched hydrocarbyl groups containing 1 to 10 carbon atoms, or mixtures thereof; and $R^3$ is hydrogen or a hydrocarbyl group containing 1 to 30 carbon atoms.

2. The lubricating composition of claim 1 wherein $R^2$ is hydrogen.

3. The lubricating composition of claim 1 wherein said salt comprises an amine or ammonia salt of caffeic acid.

4. The lubricating composition of claim 1 wherein the amine or ammonia salt of a carboxylic acid comprises an amine salt of a carboxylic acid and said amine comprises a primary amine, a secondary amine, a tertiary amine, a quaternary ammonium ion or mixtures thereof.

5. The lubricating composition of claim 1 wherein said salt is present in a range of 0.01 wt % to 10 wt % of the lubricating composition.

6. The lubricating composition of claim 1 wherein the lubricating composition is characterized as having (i) a sulfur content of 0.5 wt % or less, (ii) a phosphorus content of 0.1 wt % or less, (iii) a sulfated ash content of 1.5 wt % or less, or any combination thereof.

7. The lubricating composition of claim 1 further comprising an antiwear agent, a dispersant viscosity modifier, a friction modifier, a viscosity modifier, an antioxidant, an overbased detergent, or mixtures thereof.

8. The lubricating composition of claim 1 further comprising a metal dihydrocarbyl dithiophosphate that contributes at least 100 ppm of phosphorus to the overall composition.

9. The lubricating composition of claim 7, wherein the friction modifier is selected from the group consisting of long chain fatty acid derivatives of amines, long chain fatty esters, long chain fatty epoxides, fatty imidazolines, amine salts of alkylphosphoric acids, fatty alkyl tartrates, fatty alkyl tartrimides, fatty alkyl tartramides, and combinations thereof.

10. A method of lubricating an internal combustion engine comprising the step of: (I) supplying to the internal combustion engine the lubricating composition of claim 1.

* * * * *